US006481840B1

(12) United States Patent
Mueller et al.

(10) Patent No.: US 6,481,840 B1
(45) Date of Patent: Nov. 19, 2002

(54) AUTOMATIC DOCUMENT FEED OF PHASE CHANGE INKS

(75) Inventors: Rolf K. Mueller, Tigard, OR (US); Steven V. Korol, Dundee, OR (US); Wolfgang G. Wedler, Tualatin, OR (US); Jeffrey R. Kohne, Tualatin, OR (US); Augustus J. Rogers, IV, West Linn, OR (US); Mary Ryan-Hotchkiss, Portland, OR (US); Donald R. Titterington, Portland, OR (US); Gerard H. Rousseau, Portland, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/383,034

(22) Filed: Aug. 25, 1999

(51) Int. Cl.[7] ..... B41J 2/175; B41J 2/01
(52) U.S. Cl. ..... 347/88; 347/103
(58) Field of Search ..... 347/88, 103, 100, 347/105, 155, 212

(56) References Cited

U.S. PATENT DOCUMENTS 4,636,410 A * 1/1987 Akiya et al. ..... 347/105
4,686,118 A * 8/1987 Arai et al. ..... 347/105
4,903,041 A * 2/1990 Light ..... 347/105
5,783,658 A 7/1998 Banning et al.
5,919,839 A 7/1999 Titterington et al.
6,059,407 A * 5/2000 Komatsu et al. ..... 347/103
6,099,956 A * 8/2000 Jones ..... 428/323

* cited by examiner

*Primary Examiner*—Judy Nguyen
(74) *Attorney, Agent, or Firm*—Philip T. Virga

(57) ABSTRACT

A method of improving automatic document feed of media printed with phase change inks coats the surface of the phase change inks on the media with fine particles. The particles may include PMMA, glass bead, silica particles, crushed glass particles, kaolin clay, micronized PE and PTFE, calcium carbonate powder, hard inks or toner powder. The particles may be applied to the surface of a transfix drum by oil transfer or electrostatically prior to jetting the phase change ink, or in the case of hard inks may be jetted onto the surface of the transfix drum (offset) with the phase change ink or onto the print media (direct) after application of the phase change ink in an overprint printing process. Also the particles may be applied by a pair of finishing rollers after the media has been printed with the phase change inks, either in a direct or offset print process, the finishing roller on the print side being coated with the fine particles.

21 Claims, 12 Drawing Sheets

Fresh Print

Oil Migration Finished

FIG. 4A
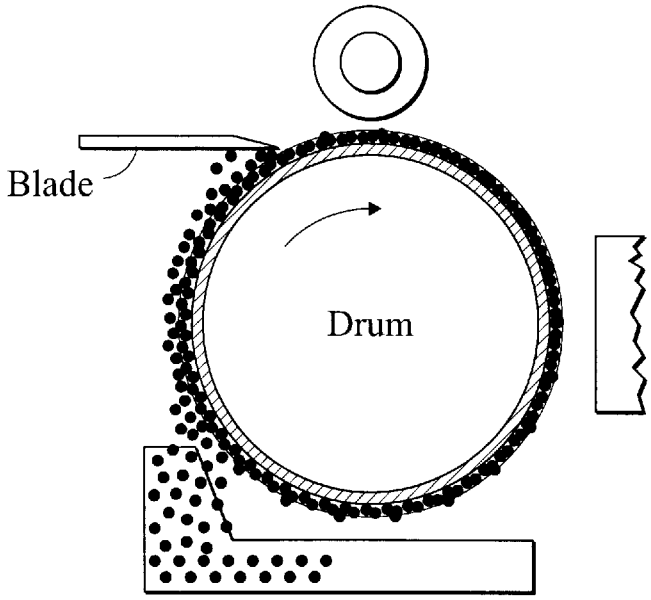
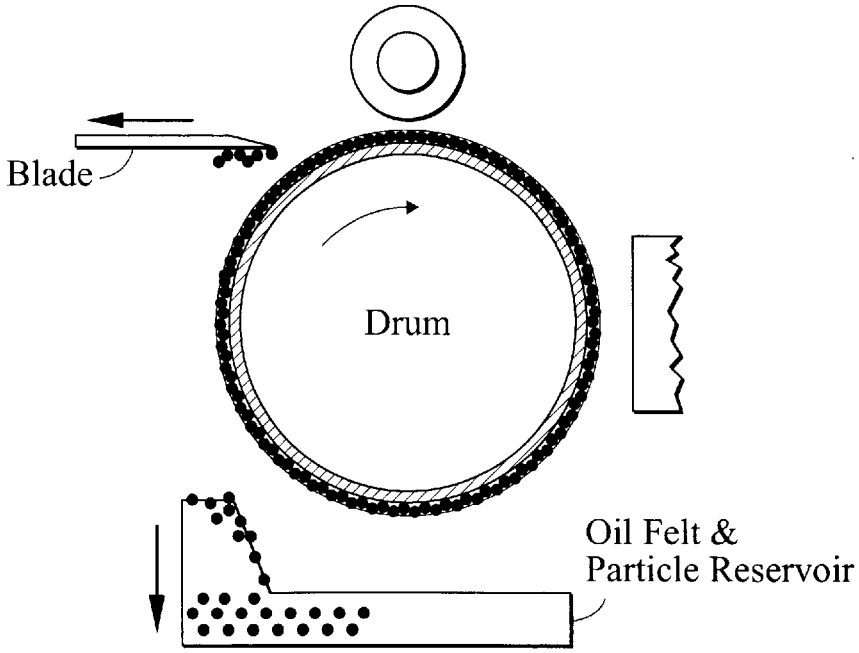
FIG. 4B

FIG. 4C
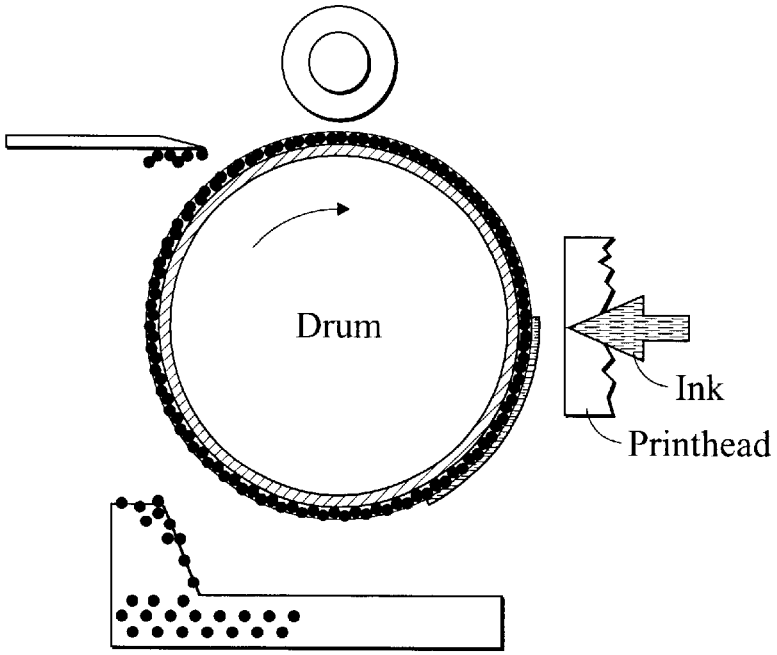
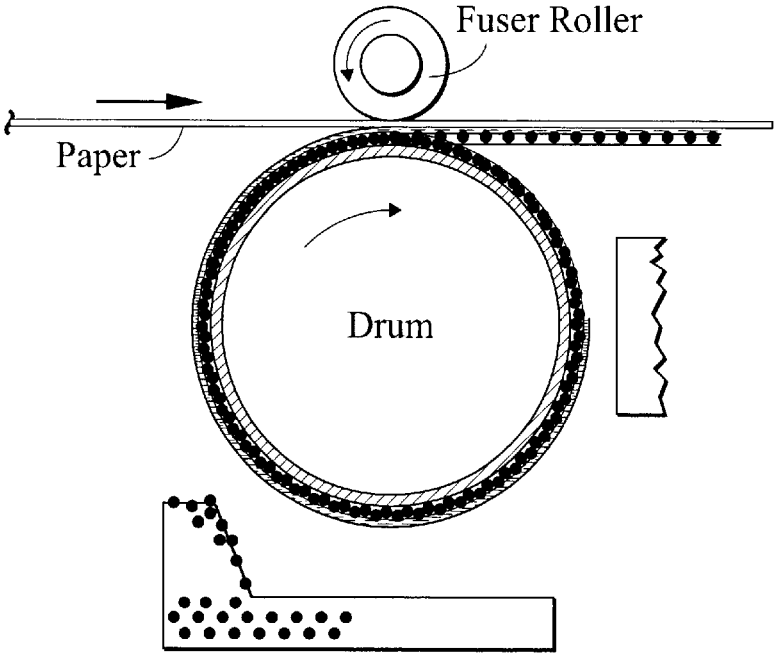
FIG. 4D

FIG. 6A
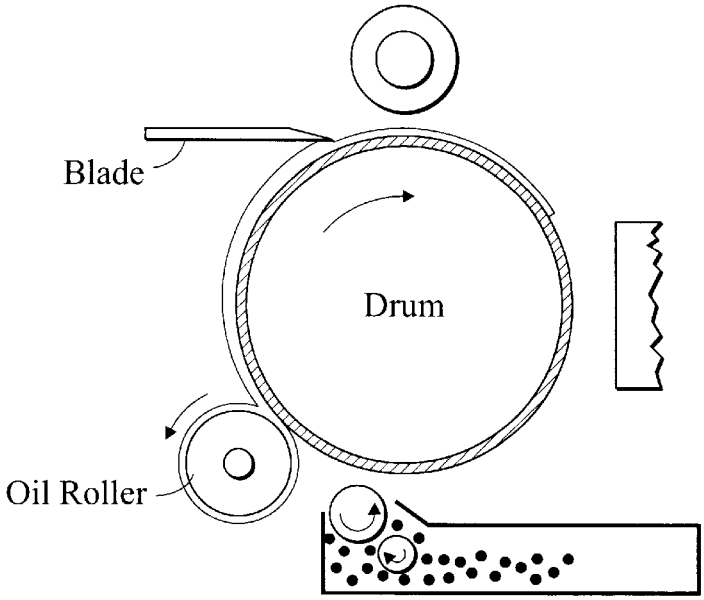
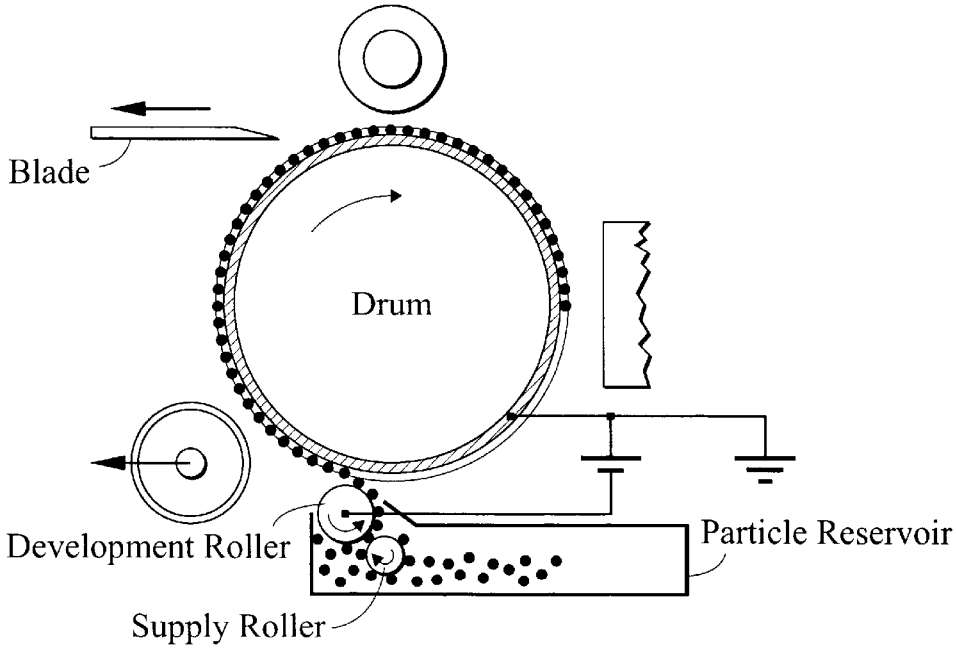
FIG. 6B

FIG. 6C
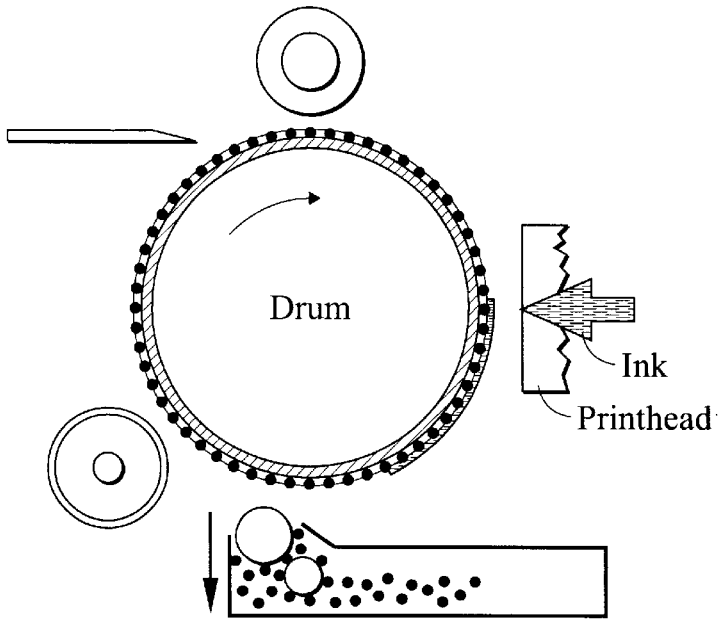
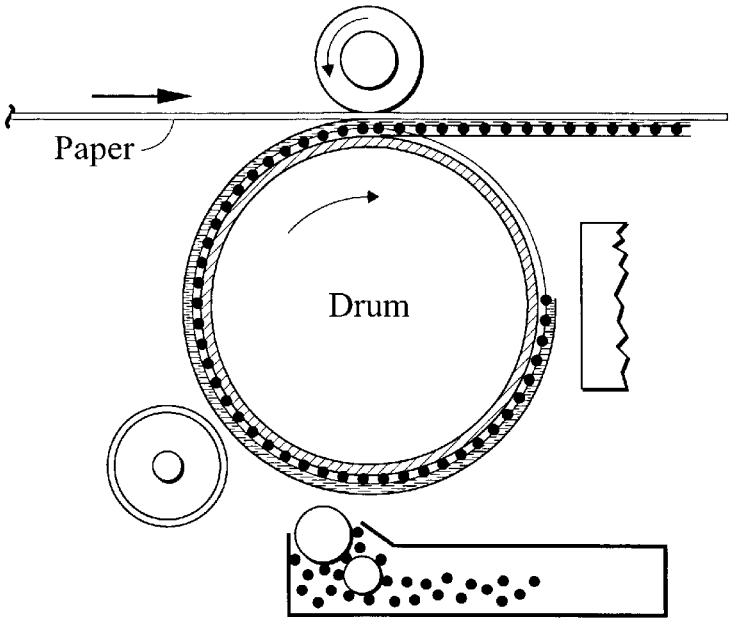
FIG. 6D

FIG. 8A
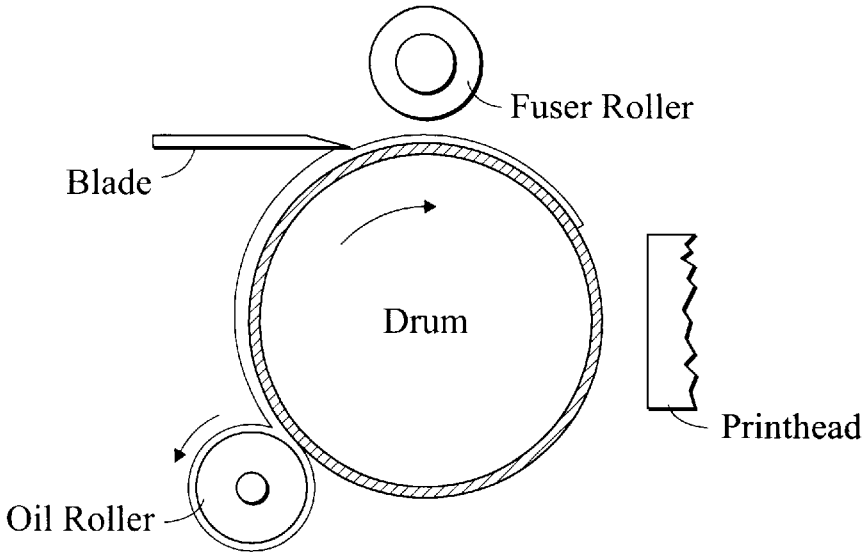
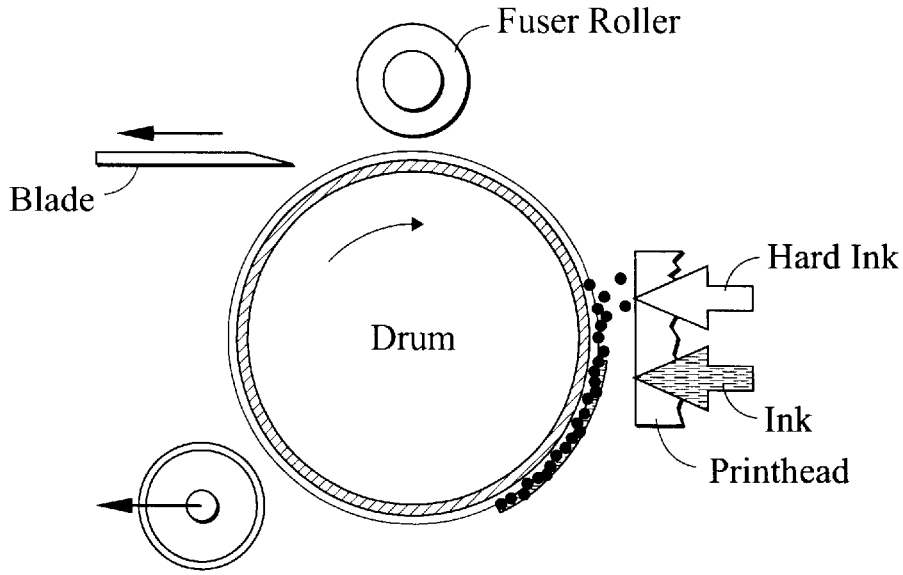
FIG. 8B

| AQ Cyan Hard Wax Study | | |
|---|---|---|
| % Coverage Hard Wax | Average Static COF | Average Kinetic COF |
| 0 | 0.733 | 0.737 |
| 10 | 0.447 | 0.444 |
| 20 | 0.431 | 0.423 |
| 40 | 0.388 | 0.388 |
| 60 | 0.322 | 0.320 |
| 80 | 0.326 | 0.325 |
| 100 | 0.295 | 0.290 |
| Cyan Laser Print | 0.314 | 0.312 |

AUTOMATIC DOCUMENT FEED OF PHASE CHANGE INKS

BACKGROUND OF THE INVENTION

The present invention relates to printing of documents using phase change ink, and more particularly to an improved automatic document feed characteristic of media printed with phase change inks.

It is a major benefit to allow printed material to slide through various types of paper handling equipment, such as office copiers, collators, paper folders and any other paper handling device that moves print media across a relatively stationary surface. Some types of inks, such as phase change inks, have sufficient friction against metal or glass surfaces that they cause documents to become jammed in the mechanical document handling equipment. This causes damage to the documents, possible contamination of the equipment, and delay and frustration for a customer while the jam is being cleared. Inability to have automatic document feed is viewed as a major shortcoming of such phase change inks.

What is desired are media printed with phase change inks that have a lower coefficient of friction to improve automatic document feed of such printed material through various paper handling equipments.

BRIEF SUMMARY OF THE INVENTION

Accordingly the present invention provides an improved automatic document feed characteristic of phase change inks on a printed document by applying very small particles to the surface of the ink on the printed document. The very small, or fine, particles may be applied to the surface of a transfix drum to which the phase change inks are subsequently applied so that, when the image is transferred from the transfix drum to the media, the fine particles coat the surface of the phase change inks on the media. The fine particles may be applied subsequent to the printing process, whether offset or direct, by passing the printed document with the phase change inks through a pair of finish rollers with the fine particles applied to one of the finish rollers so that the fine particles are embedded into the phase change inks. The fine particles also may be applied as a specially designed hard ink in an overprint process. This overprint process may be done by means of a transfix drum or by directly printing onto the print media after the phase change ink has been applied. In a transfer process the overprinting may be done simultaneously so that when the phase change ink is transferred to the media, the hard ink coats the phase change ink on the media.

The objects, advantages and other novel features of the present invention are apparent from the following detailed description when read in conjunction with the appended claims and attached drawing.

BRIEF DESCRIPTION OF THE SEVERAL VIEWS OF THE DRAWING

FIGS. 4A, 4B, 4C and 4D are representative views illustrating an alternative process using a pitted, "rough" transfix drum of a phase change ink inkjet printer with an oil metering blade to improve automatic document feed characteristics according to the present invention.

FIGS. 6A, 6B, 6C and 6D are representative views illustrating another alternative process using an electrostatic process for distributing particles on a transfix drum of a phase change ink inkjet printer to improve automatic document feed characteristics according to the present invention.

FIGS. 8A, 8B and 8C are representative views illustrating yet another process using hard inks to overprint phase change inks to improve automatic document feed characteristics according to the present invention.

DETAILED DESCRIPTION OF THE INVENTION

Figure 1:
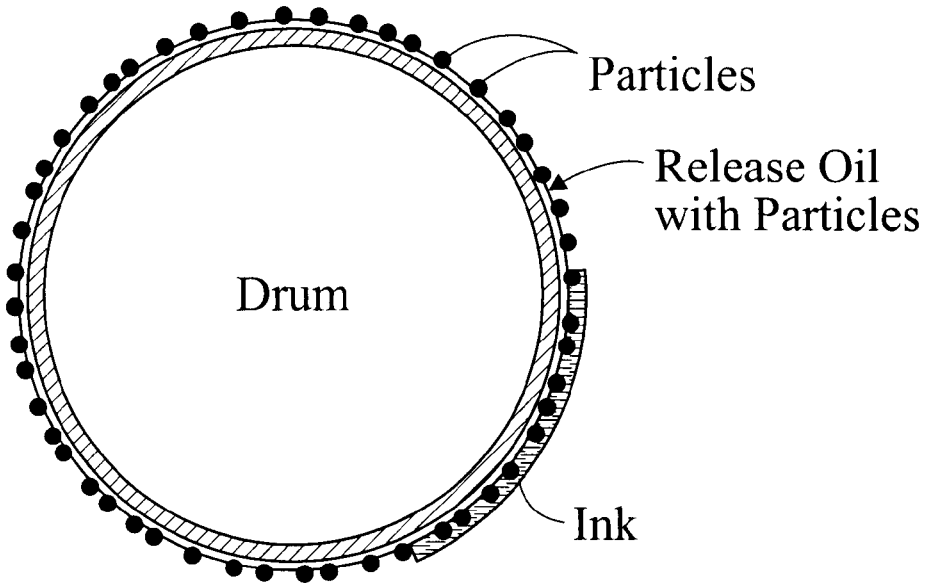
FIG. 1 is a representative view of a transfix drum for a phase change ink inkjet printer using fine particles to improve automatic document feed characteristics according to the present invention.

The basic concept of the present invention is to coat a document printed with phase change ink with a layer of very fine particles to reduce the coefficient of friction of the print samples to improve automatic document feed (ADF) characteristics of such samples. Initially polymethyl methacrylate (PMMA) beads were used to demonstrate the concept. These beads are colorless, non-toxic, chemically inert and thermally stable to above 200° C., maintain their shape up to approximately 110° C., are very small (some are less than 1 micron), are available in a wide range of sizes and shapes, and do not absorb water. A small amount of the particles, less than 10 mg, was brushed onto the surface of print samples that were known to jam a typical automatic document feed system. The treated print samples no longer jammed the ADF system. This ADF characteristic was maintained for many passes through the ADF system. In addition some of the PMMA beads were transferred to the ADF system which improved the ADF ability of subsequent untreated print samples. The residual ADF ability of the ADF system was reduced by cleaning the ADF system.

The application of the beads also results in improved writeability on the printed media. High coverage solid ink prints tend to clog pens when writing on the prints. The beads make it possible to write on a solid ink print with ordinary pens.

Specifically PMMA beads, identified as MP-1000 of 0.4 microns in size and indicated as being spherical in shape;

were obtained from Esprit Chemical Company of Sarasota, Fla., a representative of Soken Chemical and Engineering Co., Ltd. of Tokyo, Japan. Before application of the MP-1000 the print samples jammed in a representative ADF system. Approximately less than 0.01 gm of MP-1000 was applied by a bristle brush to two print samples—the first print lightly (L) and the second print heavily (H). A third print was left untreated (N). The lightly treated print was fed through the ADF system without jamming. Then the lightly and heavily treated prints were fed through the ADF system without jamming. Then the lightly and heavily treated prints were fed through the ADF system followed by the untreated sample without jaming.

Subsequently a TFE release agent/dry lubricant (MS-122DF) was sprayed on a test print sample for ten seconds in a hood. MP-1000 was wiped onto fresh print samples using a swab both horizontally and vertically on the printed side only—no powder was visible after application. Two test samples, one lightly coated and one heavily coated, were made. The following runs were made in the sequence given:

| Run | Print Samples | Result | Comments |
|---|---|---|---|
| 1 | 3 untreated | jammed after 2 | |
| 2 | 3 untreated | jammed after 2 | reversed leading edge |
| 3 | 3 untreated | jammed after 2 | before running treated |
| 4 | MS-122 treated | 1 sheet fed OK | |
| 5 | 1 untreated | 1 sheet fed OK | |
| 6 | 1 untreated | 1 sheet fed OK | |
| 7 | 2 untreated | jammed after 2 | |
| 7B | MS-122, 1 untr. | jammed after 2 | MS-122 caught in feeder |
| 8 | MP1000 L, 1 untr. | 2 sheets fed OK | |
| 9 | MP1000 H, 1 untr. | 2 sheets fed OK | |
| 10 | 1 N, 1 H, 1 L | 3 sheets fed OK | |
| 11 | 2 N, 1 H, 1 L, 1 N | all fed OK | |
| 12 | 3 fresh untreated | all fed OK | |
| 13 | 3 fresh untreated | all fed OK | |
| 14 | 6 untreated | all fed OK | sheets from 12 and 13 |
| 15 | 6 untreated | last of 6 jammed | after copy glass wiped |
| 16 | 6 untreated | last of 6 jammed | |

The addition of the very small particles is believed to minimize the contact area of the phase change ink with the surfaces of the ADF system on which the ink would not slide. The material of these particles is below its glass-transition temperature, which makes them harder than the surrounding ink. These particles form hard asperities on the surface of the print, and the particles are believed to slide due to their much smaller surface area of contact with the ADF surfaces, or roll like little ball bearings. The very small particles are believed to cling to the media surface to which they are applied because of Van der Waals forces or gross electrostatic forces—similar to filler materials in certain plastics. Materials that may be used besides the PMMA initially tested include materials such as coated and uncoated fine glass beads, silica particles, crushed glass particles, kaolin clay, micronized PE and PTFE, calcium carbonate powder, hard waxes and toner powder. The range of particle sizes may range up to 40 microns, but the preferred size range is 5–30 microns, or most preferably 7–25 microns.

Figure 2A:
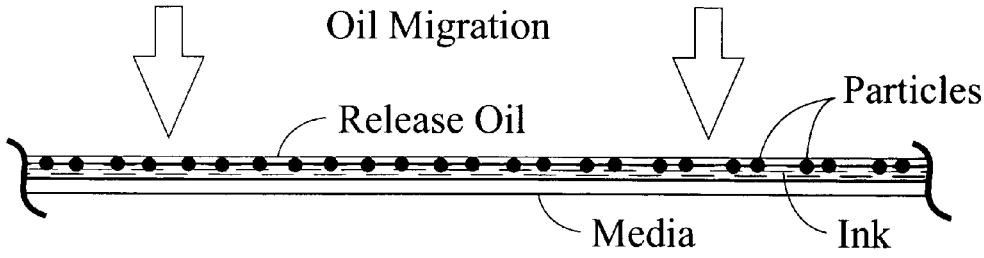
FIG. 2 is a cross-sectional view of a print sample showing how particles are embedded in the surface of phase change ink to improve automatic document feed characteristics according to the present invention.
Figure 2B:
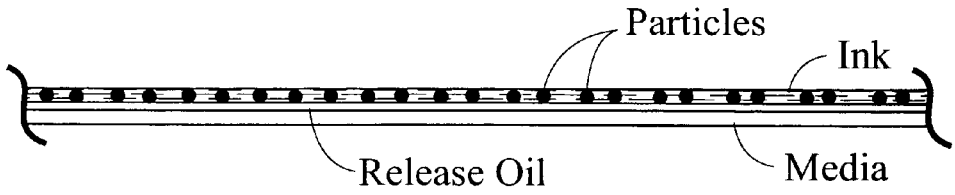
Figure 3A:
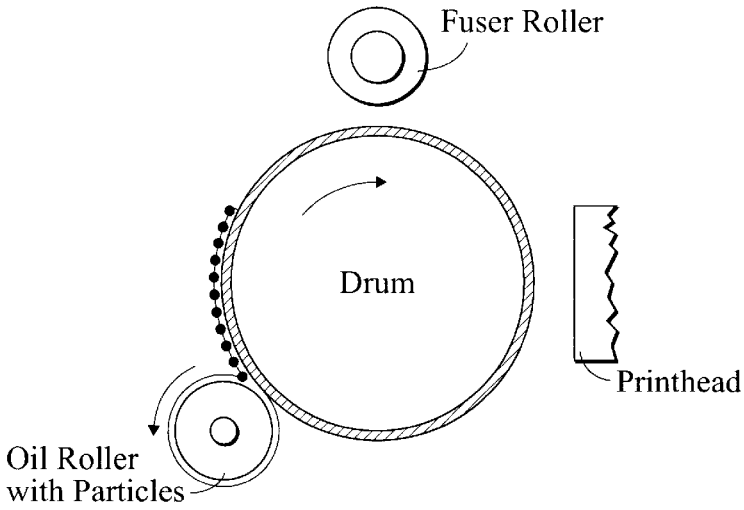
FIGS. 3A, 3B and 3C are representative views illustrating a process using a transfix drum of a phase change ink inkjet printer without an oil metering blade to improve automatic document feed characteristics according to the present invention.
Figure 3B:
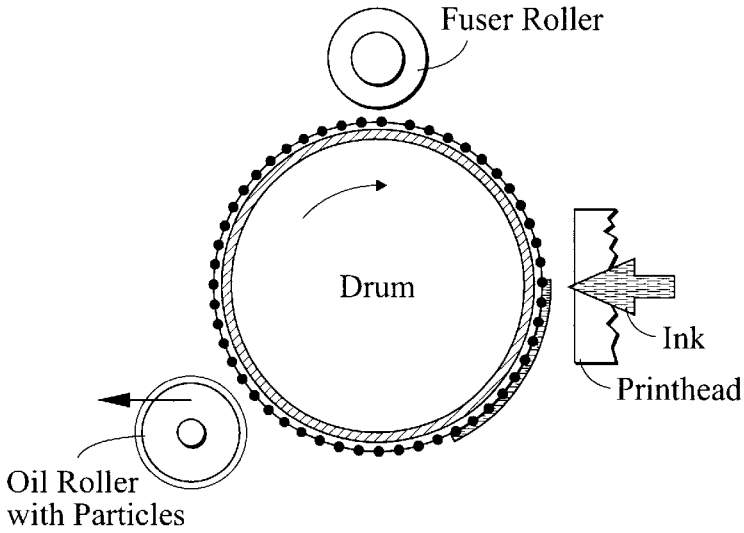
Figure 3C:
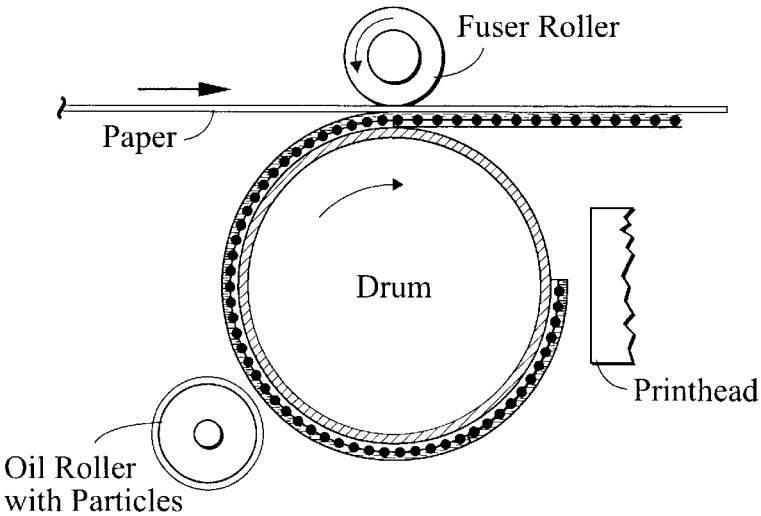

The next issue is the application of such very fine powders in a practical printer. The basic idea is to "tone" or coat the transfix drum of a phase change ink inkjet printer with the fine powder in an offset print process to provide the low coefficient of friction between the print surface and the ADF system surfaces. If the powder is applied to the drum before printing of the image, it is pressed into the surface of the ink during the transfix process and remains on the surface of the finished print. The same type of toning cartridges and applicators that are used for laser printers may be used for this purpose. Alternatively a set of finish rollers may be used to process the print after transfixing (offset printing) or after direct printing on the media (direct printing). The powder is applied to one of these rollers, either electrostatically ("dry" process) or by having the particles dispersed in silicone ("wet" process). More specifically as shown in FIG. 1, a transfix drum is coated with a release oil that includes very fine particles upon which ink is applied according to the desired image specified by an image data file. After the image is transfixed to media, as shown in FIG. 2, the ink overlies the media while the particles are embedded in the surface of the ink. The specific steps are shown more clearly in FIGS. 3A, 3B and 3C where an applicator, such as an oil roller with particles, contacts the transfix drum surface and applies the oil with particles to the surface of the transfix drum. The oil roller may be a foam delivery roller with the particles dispersed in amino-silicone oil. Then the oil roller is retracted away from the drum surface and ink is applied via an inkjet head to overlay the oil/particle layer. A transfix/fuser roller is then brought into position to form a nip with the transfix drum. Media, such as paper, is fed through the nip to transfer the image from the drum to the media.

In an alternative embodiment as shown in FIGS. 4A, 4B, 4C and 4D a transfix drum with a pitted surface is used together with an oil metering, or doctor, blade for removing excess oil from the drum surface. The "pits" are the result of a drum etch process, and the process preferrably is adapted to form pits that match the size of the fine particles being used. The transfix drum picks up oil with particles from an oil and particle reservoir, and the particles that settle into the pits on the surface of the drum survive while the others are removed by the doctor blade to return to the reservoir. The doctor blade and reservoir are then retracted and ink from an inkjet head is applied over the oil with particles. Again the transfix/fuser roller is moved toward the drum to form the nip through which the media passes to transfer the image from the drum surface to the media. In both embodiments the result is a print with particles embedded in the top surface of the ink, as shown in FIG. 2, to reduce the coefficient of friction and thus improve the automatic document feed characteristics of the print.

Figure 5:
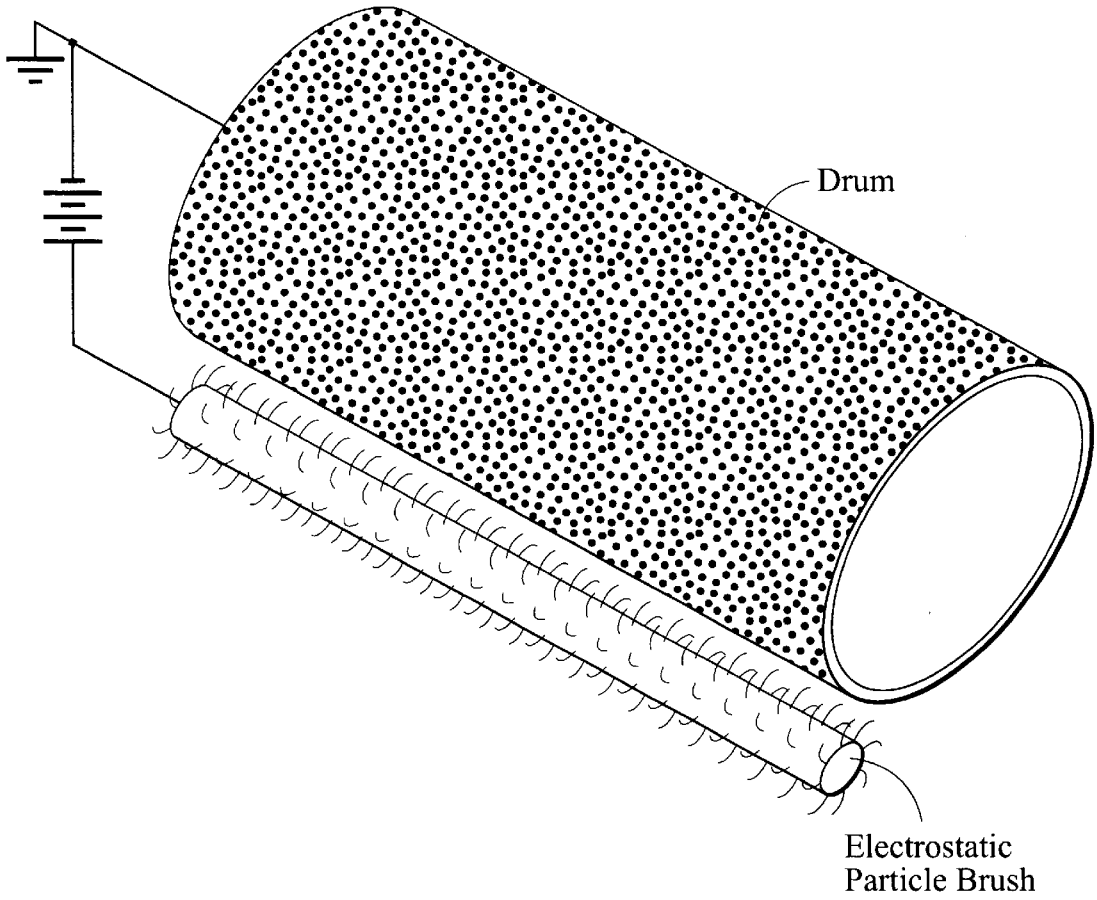
FIG. 5 is a representative view of a toner process for applying charged fine particles to the surface of a drum or roller to improve automatic document feed characteristics according to the present invention.

As shown in FIG. 5 the particles may be applied to the surface of the drum electrostatically, like toner particles, using a brush or roller that picks up the particles and applies them to the surface of the drum. Another electrostatic embodiment is shown in FIGS. 6A, 6B, 6C and 6D. An oil roller is used to apply a release agent, such as a silicone oil, to the surface of the transfix drum, with a doctor blade being used to remove excess oil. The doctor blade and roller are then retracted and the particles in a particle reservoir are transferred-via a supply roller to a development roller that charges the particles. Due to the particle charge, the particles are attracted from the reservoir to-the surface of the transfix drum. The ink image is then applied by an inkjet head to overlay the oil/particle layer. Finally the ink image is transferred to print media through a nip formed by the transfer/fuser roller and the transfix drum to produce the print image.

Figure 7:
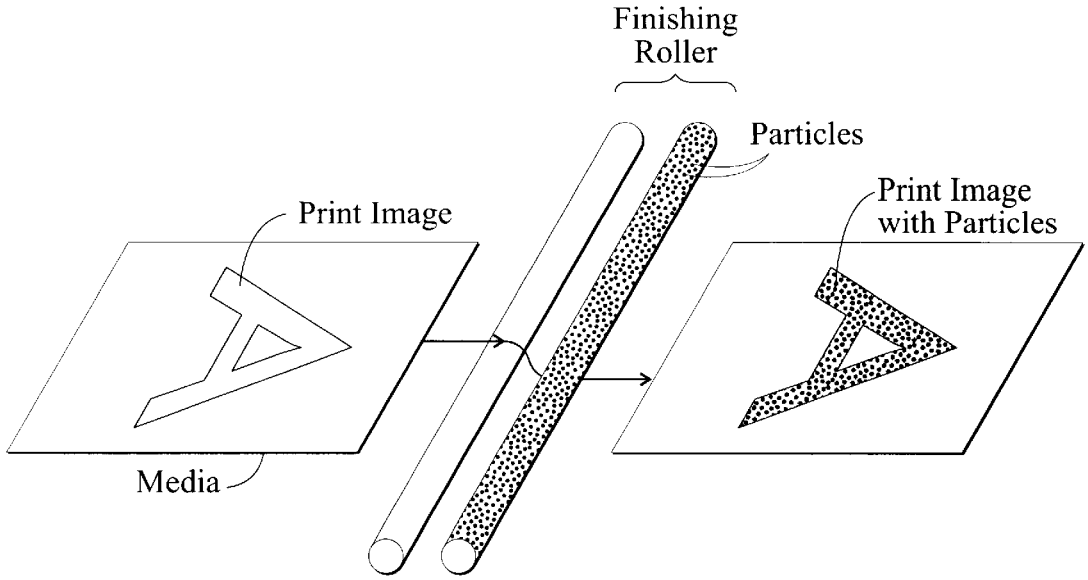
FIG. 7 is a representative view using finish rollers in a phase change ink inkjet printer for embedding fine particles in phase change ink prints to improve automatic document feed characteristics according to the present invention.

In a yet another embodiment as shown in FIG. 7 the particles may be applied by a set of finish rollers where the print-side roller has the particles which are pressed into the surface of the ink on the transfixed print. The rollers may be heated to soften the ink for better embedment of the particles in the ink surface. Again the application of the particles to the one print-side finish roller may be done electrostatically or by having the particles dispersed in silicone.

Figure 8C:
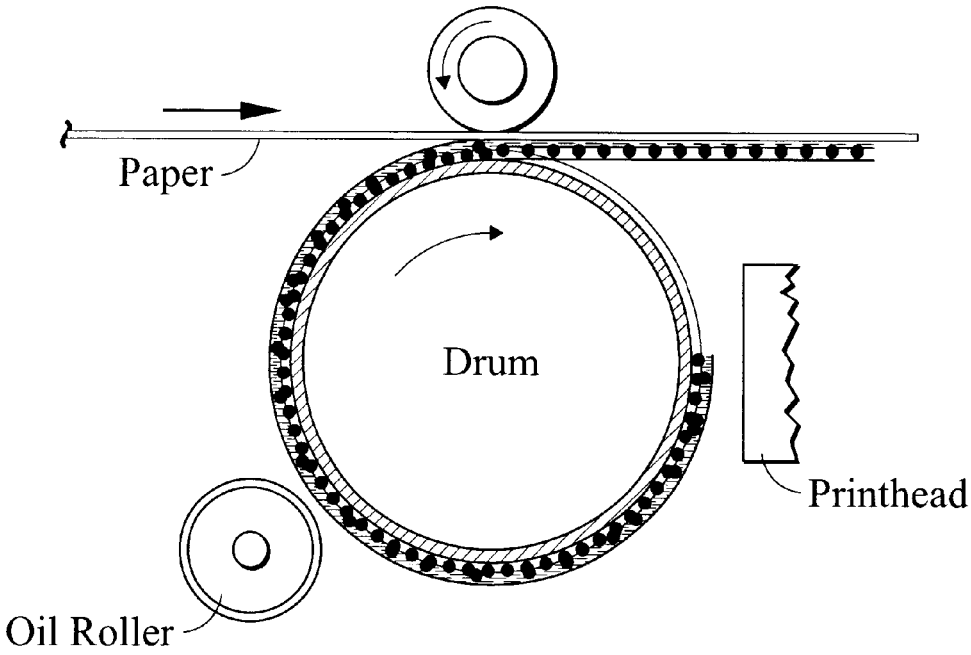

The particles may also be in the form of a matrix of dots of "hard" ink, such as specially designed polyethylene wax-based inks, or toner in the form of an overprint layer, where the overprint layer is laid down on the drum surface (offset printing) simultaneously with the ink layer analogous to an overprint process or on the print media (direct printing) after the ink layer has been applied. The ink layer and overprint layer become intimately fused during the printing and/or transfix/fuser stages so that there is no perceived structure to the overprint layer, even when it is applied in a matrix at relatively low percentages of coverage. At 20–40% coverage the coefficient of friction of the prints is low enough to make automatic document feed reliable and the blocking performance of the ink, i.e., prints offsetting or sticking when gently pressed together at slightly elevated temperatures, is noticeably improved while the durability of the print is not degraded. This range of coverage may be extended up to 60% before the wax becomes visible and so brittle that the durability and flexibility of the ink deteriorates. In this instance a separate print head or an additional row of nozzles in an existing print head are used in addition to the normal CMYK print heads or rows of nozzles in the print process shown in FIGS. 8A, 8B and 8C. Because the print does not need to be completely covered with the hard ink or toner, the head shooting this material may use many less nozzles. This is particularly applicable to high speed printing applications of phase change ink where high scuff and blocking performance is needed by the finished prints.

To illustrate this principle with an example, testing of this latter technique was done by placing a test "hard" ink, such as a hard cyan ink, made from a hard polyethylene wax in one channel of a phase change ink inkjet printer, and a colored ink formulation, such as cyan ink, in another normal ink channel, such as the cyan channel. Several test images were prepared as in FIGS. 8A, 8B and 8C where the printer was asked to print an overprint image at different percentages of the hard ink. This had the effect of placing the hard ink on the drum first followed quickly by the colored ink in the usual overprint printing mode. The samples were subjected to durability testing after printing and the coefficient of friction was measured. From such testing the coverage of 20–40% was determined to be probably optimum from the perspectives of the visibility of the hard ink and the durability and flexibility of the colored ink.

There is very little aesthetic difference between a sample print with no hard ink overcoat and a sample print coated at 40% fill. This is attributed to intimate fusing of the two different types of ink layers during the printing and transfix/fusing process. When the printing was instead performed in two separate passes, the print sample was degraded and the overprint hard ink was plainly visible and transfix performance was degraded.

EXAMPLE 1

4183-16 Unithox Colorless Resin

To a 3000 ml four-neck resin kettle equipped with a Trubore stirrer, $N_2$ atmosphere, vacuum adaptor and thermocouple-temperature controller was added about 1894.9 grams (1.06 moles) of C-50 linear alcohol ethoxylatel[1]. The C-50 linear alcohol ethoxylate was heated to 140° C. and agitation begun when molten (at approximately 100° C.). The molten C-50 linear alcohol ethoxylate was stirred and heated at temperature (~120° C.) for about one hour to remove water. A vacuum was then applied to the kettle at temperature for an additional one hour to insure that all moisture was removed. The vacuum was removed, nitrogen reapplied and about 0.60 grams of dibutyltindilaurate[2] was added. About 115.0 grams (0.52 moles) isophorone diisocyanate[3] was then added to the kettle in approximately two minutes. The reaction mixture exothermed to about 150° C. and was held at this temperature for two hours. An FT-IR of the reaction product was run to insure that all of the NCO functionality was consumed. The absence (disappearance) of a peak at ~2285 $cm^{-1}$ (NCO) and the appearance (or increase in magnitude) of peaks at ~1740–1680 $cm^{-1}$ and ~1540–1530 $cm^{-1}$ corresponding to urethane frequencies was used to confirm this. The final urethane product was then poured into aluminum molds and allowed to harden. This final product was a solid at room temperature characterized by the following physical properties: viscosity of about 69 cPs at 140° C. as measured by a Ferranti-Shirley cone-plate viscometer and a $T_m$ of about 105° C. as measured by differential scanning calorimetry using a DuPont 2100 calorimeter at a scan rate of 20° C./minute.

[1]UNITHOX 750—C-50 linear alcohol ethoxylate available from Baker Petrolite of Tulsa, Okla.

[2]FASCAT 4202—dibutyltindilaurate available from Elf Atochem North America, Inc. of Philadelphia, Pa.

[3]Desmodur I—isophorone diisocyanate available from Bayer Corp. of Pittsburg, Pa.

EXAMPLE 2

4042-93 Cyan Ink

In a stainless steel beaker were combined 217 grams of urethane resin from Example 1 of U.S. patent application Ser. No. 09/023,366, incorporated herein by reference, 254 grams of the urethane resin from Example 1 above, 313 grams of the resin from Example 1 of U.S. Pat. No. 5,783,658, incorporated herein by reference, 561 grams of Witco S-180 stearyl stearamide wax[1], 561 grams of polyethylene wax[2] and 4.0 grams of Uniroyal Naugard 445 antioxidant[3]. The materials were melted for about three hours at 125° C. in an oven, then blended by stirring in a temperature controlled mantle for ½ hour at the same temperature. To the molten ink base was added 121.8 grams of the cyan wax from Example 4 of U.S. patent application Ser. No. 08/907,805, incorporated herein by reference. The cyan ink was then stirred for an additional two hours at the same temperature. The ink was then filtered through a Mott apparatus, available from Mott Mettalurgical, at the same temperature using Whatman #3 paper at 5 psi. The ink was then poured into molds and allowed to solidify to form ink sticks. This final cyan ink product was characterized by the following physical properties: viscosity of about 12.9 cPs at 135° C. as measured by a Ferranti-Shirley cone-plate viscometer, and two melting points at about 86° C. and 98° C. as measured by differential scanning calorimetry using a DuPont 2100 calorimeter. The spectral strength of the ink was measured as about 1645 milliliters Absorbance Units per gram at a $lambda_{max}$ of 670 nm as measured by dilution in n-butanol using a Perkin-Elmer Lambda 25 UV/VIS spectrophotometer.

[1]Kemamide S-180—stearyl stearamide available from Witco Chemical Company of Memphis, Tenn.

[2]Polywax 850—available from Baker Petrolite Corporation of Tulsa, Okla.

[3]Naugard 445—antioxidant available from Uniroyal Chemical Company of Oxford, Conn.

EXAMPLE 3

3956-88B Hard, Low Coefficient-of-Friction Overprint Ink

In a stainless steel beaker were combined 1000 grams of polyethylene wax[1] and 4.97 grams of the non-polar cyan dye from Example 1 of U.S. patent application Ser. No. 09/235, 899, incorporated herein by reference. The materials were melted for about three hours at 140° C. in an oven, then blended by stirring in a temperature controlled mantle for two hours at 135° C. To the mixture was added 10 grams of filter aid material[2], and the cyan-tinted ink was then filtered through a heated (125° C.) Mott apparatus using Whatman #3 paper at 5 psi. The ink was then poured into molds and allowed to solidify to form ink sticks. This final ink product was characterized by the following physical properties: viscosity of about 9.1 cPs at 135° C. as measured by a Ferranti-Shirley cone-plate viscometer, and a melting point of about 102° C. as measured by differential scanning calorimetry using a DuPont 2100 calorimeter.

[1]Polywax 850—available from Baker Petrolite Corporation of Tulsa, Okla.

[2]Hyflo SuperCell—filter aid available from Fluka Co. of Buchs, Switzerland.

TESTING

The inks from Examples 2 and 3 were placed in a prototype phase change ink inkjet printer. The tinted overprint ink of Example 3 was placed in the yellow reservoir of the printhead, while cyan ink of Example 2 was placed in the normal cyan reservoir. Files were prepared that called for the printer to print "green" with 100% cyan fill and varying levels of "yellow" from 0–100%. In this printer architecture yellow is applied to a transfix drum before cyan, so the effect of this test was to print the tinted overprint ink on the drum first followed immediately by the cyan ink. After the transfix operation the hard ink was then on the surface of the print. With the inks being applied nearly simultaneously, as in an overprinting process, the transfer process was very efficient and the overprint ink fused into the cyan ink so as to be nearly invisible. The coefficient of friction of the print against glass was measured on a Thwing-Albert 225-1 Friction/Peel Tester interfaced to a PC running "Talas" 3.0 software. A 2.5×2.5" print sample was used with a load of 200 grams at a speed of 2"/min.

Figures 9, 10:
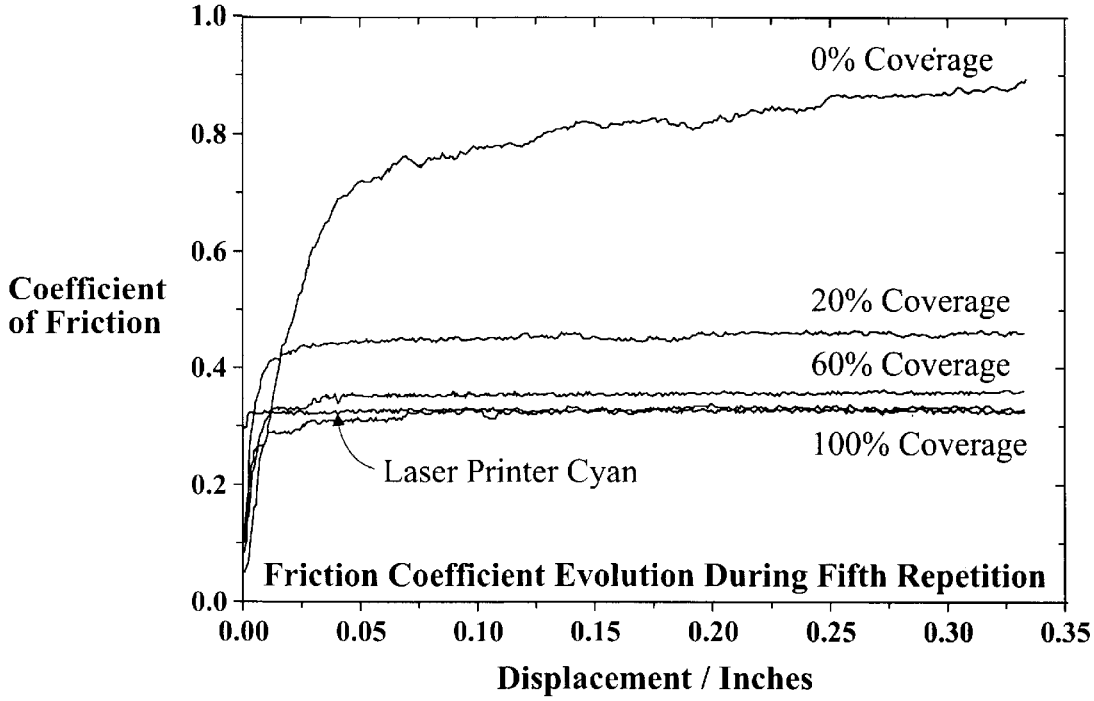
FIG. 9 is a graphic view showing the effect of different coverages of wax particles according to the present invention upon the coefficient of friction of a solid ink print compared to a laser print.
FIG. 10 is a table view of data representing the effect of different coverages of wax particles according to the present invention upon the coefficient of friction of a solid ink print compared to a corresponding laser print.

FIG. 9 shows graphically a selection of data representing the evolution of the coefficient of friction (on the ordinate) as a function of displacement in inches (abscissa) during the fifth sliding of the corresponding prints over a glass surface. Sliding speed was two inches per minute, the load was 200 g, and the testing time was ten seconds. The test was conducted by placing the 2.5×2.5 inch print sample on the lower part of a sled. The sled was then connected with the load cell of the friction tester. The test was initiated and data were gathered and processed. This procedure was repeated for a total of five tests over the same spot of the glass surface. Then the averages of the COF from the five consecutive measurements were calculated. These data are given in FIG. 10. The prints with the hard ink particle overlay were compared with the data from a similar test of a laser printer cyan solid fill print. As is apparent the COF decreases with increasing coverage and approaches values that are typical for laser printer prints.

The static COF is defined as the resistance to be overcome in order to start the sliding movement—the average of the five COF maxima at a displacement from 0 to 0.102 inches from curves which resemble those shown as examples in FIG. 9. The kinetic COF is defined as the resistance to be overcome in order to maintain sled movement—it is the average of the global averages from those five measurements.

Thus the present invention provides an improved automatic document feed characteristic to phase change ink printed media by coating the surface of the phase change ink with fine particles.

What is claimed is:

1. A method of reducing the coefficient of friction or improving the writeability of a phase change ink printed media comprising:

toning a surface of a transfix drum of a phase change ink inkjet printer with fine particles;

jetting a phase change ink onto the surface of the transfix drum over the fine particles; and transferring the phase change ink and fine particles from the transfix drum to media to produce the phase change ink printed media coated with the fine particles.

2. The method as recited in claim 1 wherein the particles are colorless, non-toxic, chemically inert and thermally stable.

3. The method as recited in claim 1 wherein the particles are less than forty microns in size.

4. The method as recited in claim 1 wherein the particles have a size in the range from 0.4 to forty microns.

5. The method as recited in claim 1, wherein the particles have a size in the range from five to thirty microns.

6. The method as recited in claim 1 wherein the particles have a size in the range from seven to twenty-five microns.

7. The method as recited in claim 1 wherein the particles are spherical in shape.

8. The method as recited in claim 1 wherein the fine particles are selected from the group consisting of polymethyl methacrylate beads, fine glass beads, silica particles, crushed glass particles, kaolin clay, micronized PE and PTFE, calcium carbonate powder, hard waxes and toner powder.

9. The method as recited in claim 1 wherein the toning step comprises the steps of:

jetting a hard ink as the fine particles to a surface of a transfix drum as part of an overprint printing process.

10. The method as recited in claim 1 wherein the toning step comprises the steps of:

applying an oil to the surface of the transfix drum, the oil containing the fine particles; and wiping excess oil from the surface of the transfix drum after the applying step.

11. The method as recited in claim 10 wherein the transfix drum has a pitted surface to retain the fine particles after the wiping step.

12. The method as recited in claim 11 wherein the size of the pits in the surface of the transfix drum is matched to the size of the fine particles.

13. The method as recited in claims 11 or 12 wherein the pits in the surface of the transfix drum are formed by an etching process adapted to produce a desired size for the pits.

14. The method as recited in claim 1 wherein the toning step comprises the step of electrostatically applying the fine particles to the surface of the transfix drum.

15. The method as recited in claim 1 wherein the toning step comprises the steps of:

applying an oil to the surface of the transfix drum; and electrostatically applying the fine particles to the oil on the surface of the transfix drum.

16. The method as recited in claim 14 wherein the electrostatically applying step comprises the step of:

picking up the fine particles with a brush;

charging the brush and the transfix drum with opposite polarities; and applying the fine particles to the surface of the transfix drum with the brush so that the fine particles electrostatically adhere to the surface of the transfix drum.

17. The method as recited in claims 14 or 15 wherein the electrostatically applying step comprises the steps of:

charging the fine particles in a distribution receptacle with a charge opposite to that of the transfix drum; and distributing the fine particles electrostatically from the distribution receptacle to the surface of the transfix drum.

18. The method as recited in claim 9 wherein the hard ink is jetted by a separate print head from the phase change ink.

19. The method as recited, in claim 9 wherein the hard ink forms a 20–40% fill coating over the phase change ink of the phase change ink printed media.

20. The method as recited in claim 9 wherein the hard ink is jetted by a separate row of apertures in a phase change ink print head having multiple aperture rows for the phase change ink.

21. The method as recited in claim 20 wherein the number of apertures in the hard ink row is less than the number of apertures in the phase change ink rows.

* * * * *